United States Patent [19]

Hirano

[11] Patent Number: 4,773,782

[45] Date of Patent: Sep. 27, 1988

[54] APPARATUS FOR TRANSFERRING SHEET MATERIAL

[75] Inventor: Hirofumi Hirano, Kawasaki, Japan

[73] Assignee: Canon Kabushiki Kaisha, Tokyo, Japan

[21] Appl. No.: 921,433

[22] Filed: Oct. 22, 1986

[30] Foreign Application Priority Data

| | | | |
|---|---|---|---|
| Oct. 28, 1985 | [JP] | Japan | 60-239295 |
| Oct. 28, 1985 | [JP] | Japan | 60-239296 |
| Dec. 3, 1985 | [JP] | Japan | 60-185558 |

[51] Int. Cl.[4] ..... B41J 13/02; B41J 13/10

[52] U.S. Cl. ..... 400/637; 400/642; 271/314

[58] Field of Search ..... 400/631, 636, 637, 637.1, 400/637.3, 637.4, 637.5, 637.6, 638, 641, 642, 647.1; 271/314

[56] References Cited

U.S. PATENT DOCUMENTS

| | | | |
|---|---|---|---|
| Re. 31,747 | 11/1984 | Shakib et al. | 400/637.6 X |
| 953,898 | 4/1910 | Cook | 400/637.5 |
| 1,376,879 | 5/1921 | Holden | 400/637.4 |
| 1,453,577 | 5/1923 | Armstrong | 400/637.3 X |
| 1,547,326 | 7/1925 | Hokanson | 400/637.6 |
| 1,988,789 | 1/1935 | Dobson | 400/637.1 |
| 2,506,934 | 5/1950 | Miller | 400/637.4 X |
| 3,223,221 | 12/1965 | Arthur | 400/637.4 X |
| 4,215,945 | 8/1980 | Habich et al. | 400/637.6 X |
| 4,611,802 | 9/1986 | Pederson | 400/637.6 X |
| 4,611,939 | 9/1986 | Fujiwara | 400/637 |

FOREIGN PATENT DOCUMENTS

| | | | |
|---|---|---|---|
| 0108388 | 5/1984 | European Pat. Off. | 400/637 |
| 545352 | 2/1932 | Fed. Rep. of Germany | 400/637.1 |
| 3141102 | 4/1983 | Fed. Rep. of Germany | 400/642 |
| 0178273 | 10/1984 | Japan | 400/637.5 |
| 228220 | 8/1943 | Switzerland | 400/637 |

*Primary Examiner*—E. H. Eickholt

*Attorney, Agent, or Firm*—Fitzpatrick, Cella, Harper & Scinto

[57] ABSTRACT

A sheet material transferring apparatus of the type including a transferring roller about which the sheet material is wound, a sheet guiding member and a sheet retainer. The sheet guiding member is formed with a plurality of openings through which pinch rollers are projected inwardly. When it is turned in the one direction by actuating a lever, it assumes an operative position where the pinch rollers and the sheet retainer are brought in pressure contact with the circumferential surface of the sheet guiding member while the spaced relation between the sheet guiding member and the transferring member is maintained whereby the sheet material is transferred along the circumferential surface of the transferring roller. When it is turned in the other direction, it assumes the inoperative position where both the pinch rollers and the sheet retainer are parted away from the circumferential surface of the transferring roller that the sheet material to be transferred is freely inserted into the clearance as defined therebetween so as to allow the sheet material to assume a correct position or orientation. The sheet guiding member is operatively connected to an outer sheet guiding member by meshing engagement of projections and recesses which are formed at the one end of each of them. The sheet retainer may be provided with resilient deforming portions adapted to abut against the one end of the sheet guiding member.

11 Claims, 4 Drawing Sheets

APPARATUS FOR TRANSFERRING SHEET MATERIAL

BACKGROUND OF THE INVENTION

1. Field of the Invention

The present invention relates to an apparatus for transferring sheet material of the type including guiding means of which a guiding surface is spaced away from the circumferential surface of a rotational transferring member and pressing means for pressing the sheet material against the rotational transferring member so that transferring is achieved in such a manner that the sheet material is wound about the rotational transferring member.

2. Related Background Art

Generally, a conventional recording apparatus such as printer or the like is so constructed that recording is effected while a sheet of recording medium (hereinafter referred to as recording sheet or sheet) is transferred and in most of the conventional recording apparatuses transferring of the recording sheet is achieved in accordance with the so-called friction feed system in which pinch rollers are brought into pressure contact with the rotational transferring roller and the recording sheet is transferred along the circumferential surface of the transferring roller while it is held between both rollers.

When it becomes necessary that the recording sheet assumes a correct position or orientation prior to starting the transferring operation in the above-mentioned type of transferring apparatus in which the pinch rollers are brought into pressure contact with the pinch roller or when transferring is achieved in accordance with the so-called pin tractor feed system in which the transferring roller is provided with a plurality of pins which are projected from the circumferential surface thereof and onto which small holes on both the end parts of the recording sheet are fitted during the transferring operation, there is a necessity for releasing the transferring roller and the pinch rollers for the pressure contact state.

Accordingly, it has been pointed out as problems inherent to the conventional sheet transferring apparatus adapted to be operated in accordance with the friction feed system that the apparatus is provided with specially designed pressure contact releasing members, actuating lever shafts or like means in order to assure that the pinch rollers are displaced away from the transferring roller, resulting in an increased number of components and increased manufacturing cost of the apparatus.

Especially, in the case where the apparatus is equipped with a number of pinch rollers which are arranged in plural lines, it is unavoidable that the structure of the apparatus becomes complicated.

Generally, the conventional recording apparatus such as a printer or the like is so constructed that recording is effected while a recording sheet is transferred along the circumferential surface of the transferring roller. However, when the sheet is floated up above the circumferential surface of the transferring roller during recording operation, it results that normal recording cannot be achieved as required. To inhibit an occurrence of floating-up in that way, arrangement is made for the conventional recording apparatus such that a sheet retainer made of a resilient thin plate is caused to come into pressure contact with the transferring roller. Thus, the sheet retainer inhibits the recording sheet from floating up above the circumferential surface of the transferring roller.

To assure that an occurrence of floating-up is inhibited without fail even when a firm recording sheet such as thick paper or like material is used, it is necessary that the sheet retainer is brought into pressure contact with the transferring roller with a sufficiently high intensity of pressure contact force.

However, when it is required that a recording sheet assumes a correct position or orientation or when transferring is effected in accordance with the so-called pin tractor feed system in which the transferring roller is provided with a number of pins which are projected outwardly therefrom and onto which feeding holes on both the end parts of the recording sheet are fitted during transferring operation, it is preferable from the viewpoint of manoeuvrability that the sheet retainer is brought into pressure contact with the transferring roller with a reduced intensity of pressure contact force. When pressure contact force has excessively high intensity, the recording sheet is forcibly pulled under the effect of this pressure contact force. Thus, there is a fear of causing elongation of the feeding holes or breakage of the same.

In view of the fact as mentioned above it has been requested that arrangement is made for the recording apparatus so as to properly adjust the pressure contact force to be imparted by means of the sheet retainer. However, to meet the requirement there is the necessity for additionally attaching a pressure contact force adjusting member to the apparatus, resulting in the increased number of components and increased manufacturing cost of the apparatus. For that reason no countermeasure has been hitherto taken.

Further, to assure that a recording sheet is transferred without fail a conventional recording apparatus is provided with guiding means having a guiding surface which is spaced away from the circumferential surface of the transferring roller. In addition, another guiding means is provided in order to bring to the first-mentioned guiding means the recording sheet which is fed through a sheet insert slit. However, it is found that an interrupted area is produced at the connection parts of both the guiding means when the first-mentioned guiding means is turned along the transferring roller and production of the interrupted area in that way inhibits smooth transference of the recording sheet.

SUMMARY OF THE INVENTION

Hence, the present invention has been made with the foregoing background in mind.

It is an object of the present invention to provide an apparatus for transferring sheet material which assures that the pressing force imparted by pressing means which is kept in pressure contact with a rotational transferring member can be changed without the use of any specially designed member.

It is another object of the present invention to provide an apparatus for transferring sheet material which assures that a plurality of pressure rollers come into contact with and out of contact with the rotational transferring member without the use of any specially designed member.

It is another object of the present invention to provide an apparatus for transferring sheet material which assures that the pressing force imparted by a sheet retainer can be properly adjusted without the use of any specially designed member.

It is further another object of the present invention to provide an apparatus for transferring sheet material which assures that no interrupted area is produced between first guiding means and second guiding means adapted to be connected to the former even when the first guiding means is turned around the rotational transferring member.

To accomplish the above objects there is proposed, according to one aspect of the present invention, an apparatus for transferring sheet material essentially comprising a rotational transferring member for transferring the sheet material which is wound about the circumferential surface thereof, means for pressing the sheet material against the rotational transferring member, and guiding means having a curved guiding surface spaced away from the circumferential surface of the rotational transferring member by a predetermined distance, disposed to turn along the circumferential surface of the rotational transferring member in such a manner that the predetermined distance is kept substantially unchanged and including an engagement portion adapted to come into engagement with the pressing means while maintaining the spaced relation relative to the latter, the guiding means being adapted to change at least the pressing force of the pressing means to be imparted to the rotational transferring member when it is turned relative to the rotational transferring member.

Further, there is proposed according to other aspect of the present invention an apparatus for transferring sheet material essentially comprising a rotational transferring member for transferring the sheet material which is wound about the circumferential surface thereof, first guiding means having a curved guiding surface spaced away from the circumferential surface of the rotational transferring member by a predetermined distance and disposed to turn along the circumferential surface of the rotational transferring member in such a manner that the predetermined distance is kept substantially unchanged, second guiding means having a guiding surface in continuation from a guiding surface of the first guiding means, the second guiding means being operatively connected to the first guiding means, and both the first and second guiding means having a connecting part comprising a plurality of projections and a plurality of recesses respectively by way of which they are connected to one another by meshing engagement.

Other objects, features and advantages of the present invention will become more clearly apparent from reading of the following description which has been prepared in conjunction with the accompanying drawings.

DESCRIPTION OF THE PREFERRED EMBODIMENTS

Now, the present invention will be described in a greater detail hereunder with reference to the accompanying drawings which illustrate preferred embodiments thereof.

Figure 1:
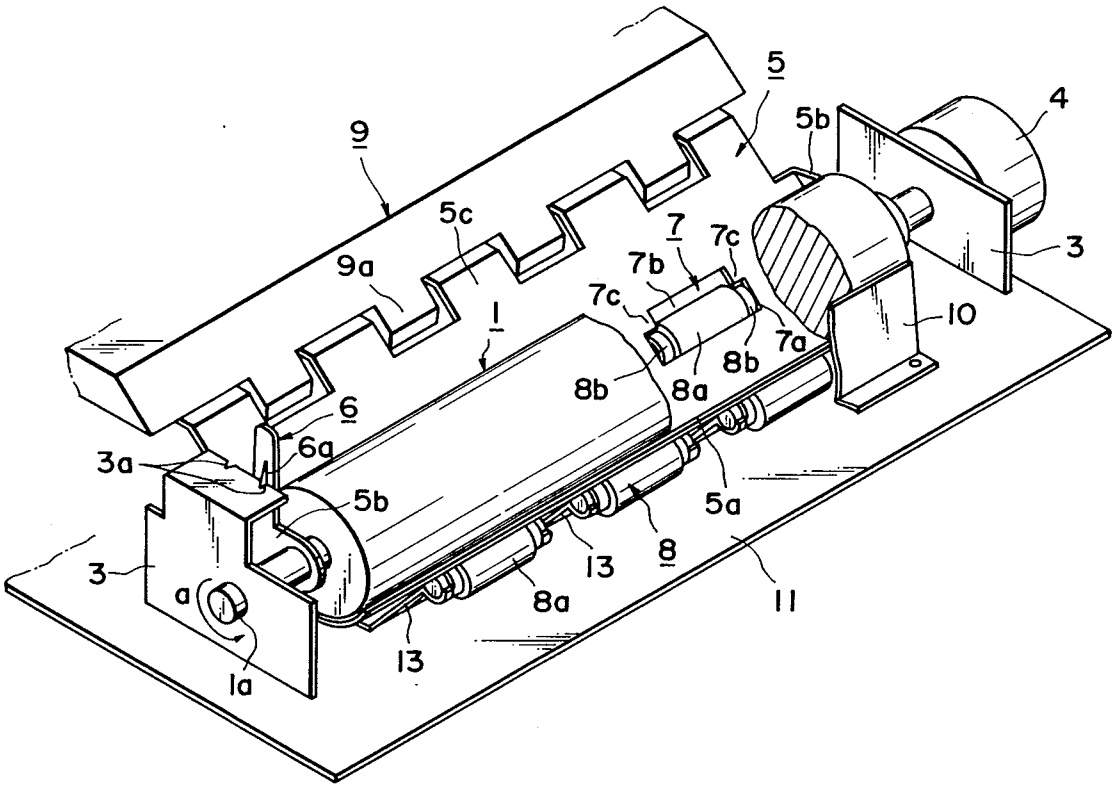
FIG. 1 is a partially explored perspective view of an apparatus in accordance with an embodiment of the invention.
Figure 2:
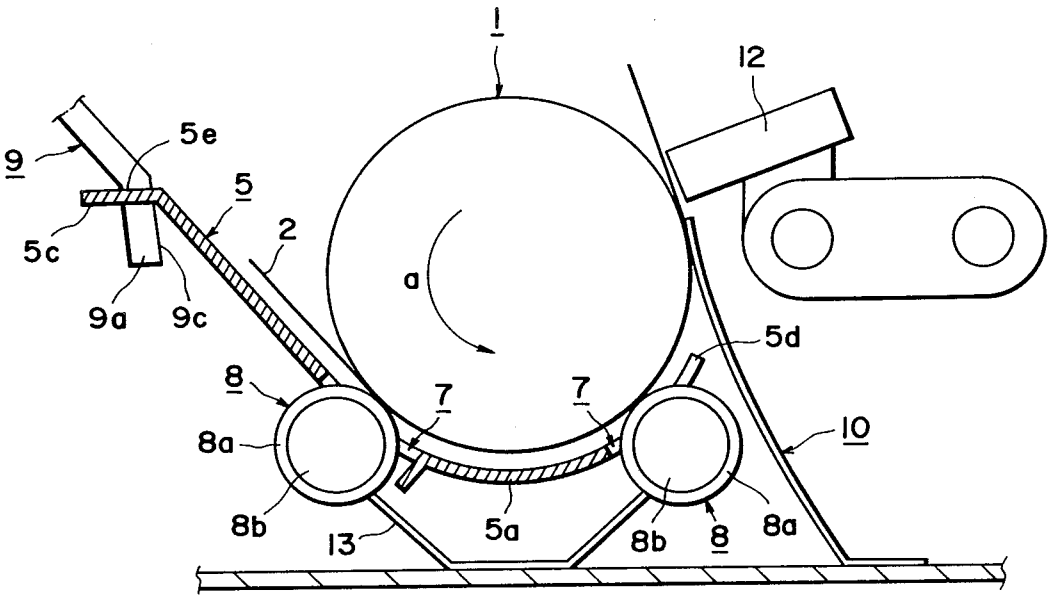
FIGS. 2 and 3 are vertial sectional views of the apparatus in FIG. 1 respectively.

FIG. 1 is a perspective view of an apparatus for transferring sheet material in accordance with an embodiment of the invention and FIG. 2 is a schematic vertical sectional view of the apparatus in FIG. 1.

In the drawings reference numeral 1 designates a transferring roller in the form of a rotational member which serves to transfer a sheet of recording medium 2 (hereinafter referred to as recording sheet 2 or sheet 2) along the circumferential surface thereof. As will be apparent from the drawings, the transferring roller is constructed in the cylindrical configuration using SBR rubber, CR rubber, NBR rubber or the like material having a high friction coefficient, the length of which is determined substantially equal to the width of the recording sheet 2. A center shaft 1*a* of the transferring roller 1 is rotatably supported by means of side plates 3 so that it is rotationally driven in the direction as identified by an arrow a in the FIG. 2 by activating a motor 4 which is operatively connected to the center shaft 1*a*.

Further, reference numeral 5 designates a sheet guiding member made of steel material for guiding movement of the recording sheet 2 which is transferred by means of the transferring roller 1. The sheet guiding member 5 includes a rounded portion 5*a* which is extended along the lower part of the transferring roller 1 in spaced relation and moreover it includes arm portions 5*b* at both the ends thereof as seen in the longitudinal direction of the transferring roller 1. The arm portions 5*b* are pivotally mounted on the center shaft 1*a* of the transferring roller 1 and one of them is integrally provided with a turning lever 6 which is projected therefrom in the upward direction whereby the sheet guide member 5 can be turned by actuating the lever 6 while the spaced relation relative to the circumferential surface of the transferring roller 1 is maintained.

The rounded portion 5*a* of the sheet guide member 5 is formed with a plurality of openings 7 through which pinch rollers 8 serving as pressure rollers are brought into pressure contact with the circumferential surface of the transferring roller. Thus, each of the pinch rollers 8 is rotated as the transferring roller 1 is rotated.

Further, the sheet guiding member 5 includes a comb-shaped portion 5*c* along the one side thereof as seen in the direction of movement of the recording sheet 2. As is apparent from FIG. 2, the comb-shaped portion 5*c* comprises a plurality of projections and recesses which are located alternately. An outer sheet guiding member disposed adjacent to the sheet guiding member 5 also includes a comb-shaped portion 9*a* which comprises a plurality of projections and recesses which are located alternately in such a manner that the projection on the sheet guiding member 5 enters the recess on the outer sheet guiding member 9 and the recess on the former receives the projection on the latter therein.

Namely, the projections and the recesses on both the joint parts of the sheet guiding member 5 and the outer sheet guiding member 9 mesh with one another in the alternate manner.

Figure 3:
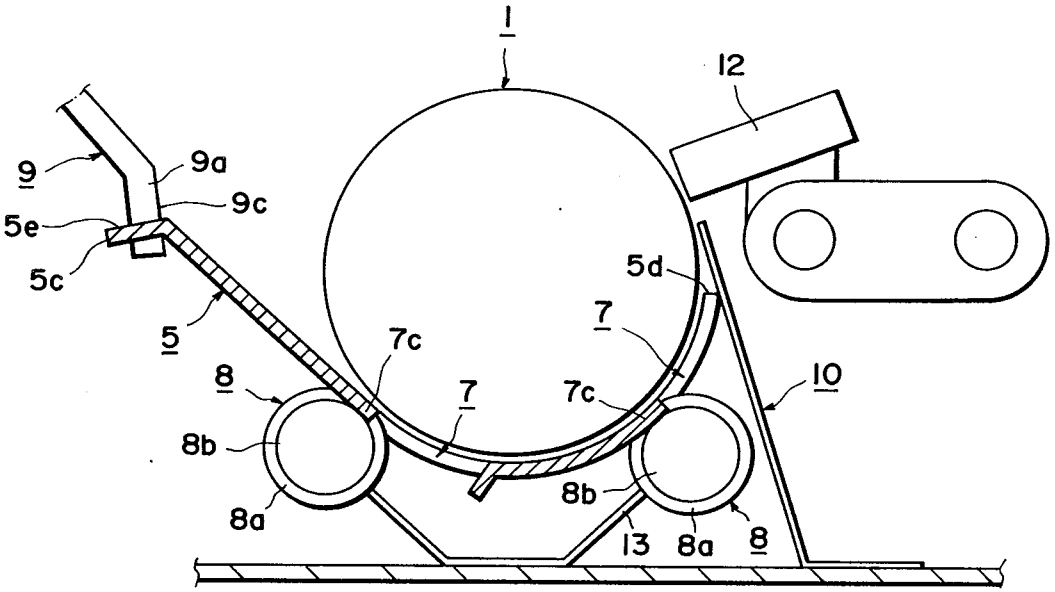

As shown in FIGS. 2 and 3, each of the projections in the comb-shaped parts 5*c* and 9*a* of the sheet guiding member 5 and the outer sheet guiding member 9 has a rearward inclined face 5e or 9c which in parted away from the guiding surface.

In the drawings reference numeral 10 designates a sheet retainer for inhibiting the recording sheet 2 from floating up from the circumferential surface of the transferring roller 1 during transferring operation of the recording sheet 2. Usually, the sheet retainer 10 is made of metallic thin plate of a stainless steel or the like and its one end is fixedly secured to the base plate 11 in order to assure that its other end comes in pressure contact with the downstream part of the transferring roller 1 as seen in the direction of rotation of the latter. Reference numeral 12 designates an ink jet type recording head for recording an image on the recording sheet 2 in response to a transmitted signal.

Next, description will be made in more details below as to each of the members constituting the apparatus.

First, description will be made as to the relation between the openings 7 and the pinch rollers 8. As is apparent from FIG. 1, each of the openings 7 comprises a large opening 7a and a smaller opening 7b in the inverted T-shaped form and releasing portions 7c are formed in the boundary area between the larger opening 7a and the smaller opening 7b. On the other hand, the pinch roller 8 is made of hard plastic, SBR rubber or the like material in the cylindrical configuration and comprises a pressure contact portion 8a and releasing cylindrical portions 8b on both the sides of the pressure contact portion 8a the diameter of which is determined smaller than that of the latter. The releasing cylindrical portions 8b are normally urged toward the transferring roller 1 under the effect of resilient force of a leaf spring 13 which is fixedly secured to the base plate 11 and moreover they are rotatably supported by means of the leaf spring 13. It should be noted that the longitudinal dimension of the larger opening 7a is determined appreciably larger than the longitudinal dimension of the pinch roller 8 and the longitudinal dimension of the smaller opening 7b is determined appreciably longer than the longitudinal dimension of the pressure contact portion 8c of the pinch roller 8.

Next, description will be made below as to the releasing lever 6. As will be best seen in FIG. 1, it is integrally formed with a projection 6a having the triangular sectional contour which is projected outwardly, while the side plate 3 is formed with a plurality of V-shaped recesses 3a into which the projection 6a on the releasing lever 6 enters. When the sheet guiding member 5 is turned with the aid of the releasing lever 6, the projection 6a is disengaged from the one recess 3a and the lever 6 is displaced until the projection 6c comes in engagement to the other recess 3a and it is immovably kept there.

Next, description will be made below as to the relation between the sheet guiding member 5 and the sheet retainer 10 with reference to FIG. 2. As is apparent from the drawing, when the sheet guiding member 5 is turned in the upstream direction of rotation of the transferring roller 1, the end part 5d of the sheet guiding member 5 is parted away from the sheet retainer 10. When the sheet guiding member 5 is turned in the down-stream direction of rotation of the transferring roller 1, the end part 5d of the sheet guiding member 5 comes into contact with the sheet retainer 10 whereby the latter is parted away from the circumferential surface of the transferring roller 1, as shown in FIG. 3.

Now, operation of the apparatus of the invention as constructed in the above-mentioned manner will be described below.

First, in the case wherein the recording sheet 2 is transferred under the effect of cooperation of the transferring roller 1 with the pinch rollers 8, the sheet guiding member 5 is turned in the upstream direction of rotation of the transferring roller 1, as shown in FIG. 2. At this moment the pinch rollers 8 are projected through the larger openings 7a on the sheet guiding member 5 and thereby their pressure contact portions 8a are brought into pressure contact with the circumferential surface of the transferring roller 1.

As the transferring roller 1 is rotated in the direction as identified by an arrow a while both the rollers 1 and 8 are kept in contact with one another, the pinch rollers 8 are driven in accordance with rotation of the transferring roller 1 whereby a recording sheet 2 is transferred along the circumferential surface of the transferring roller 1 after passing through the clearance between both the rollers 1 and 8. During transferring movement of the recording sheet 2 the sheet guiding member 5 functions as guiding means for the recording sheet 2 which has been transferred in that way.

In the case where adjustment is required so as to allow the recording sheet 2 to assume the correct position relative to the transferring roller 1 or in the case where it is transferred in accordance with the pin tractor feed system, the sheet guiding member 5 is turned in the downward direction of rotation of the transferring roller 1 by actuating the releasing lever 6, as shown in FIG. 3. This leads to a result that the releasing cylindrical portions 8b of the pinch rollers 8 are depressed by the releasing portions 7c on the sheet guiding member 5 and thereby the pressure contact portions 8a of the pinch rollers 8 are parted away from the outer surface of the transferring roller 1. Thus, both the rollers 1 and 8 are released from the pressure contact state and the sheet retainer 10 is parted away from the outer surface of the transferring roller 1.

As a result, the recording sheet 2 can be fed along the outer surface of the transferring roller 1 without any resistance. Also as this moment the sheet guiding member 5 functions as guiding means for the recording sheet 2.

It should be noted that even when the sheet guiding member 5 is turned so as to allow the pinch rollers 8 to be released from the pressure contact state, the comb-shaped parts 5c and 9a of the sheet guiding member 5 and the outer sheet guiding member 9 both of which are located on the inlet side for the recording sheet 2 are still kept in meshing engagement with one another as shown in FIG. 3 without any formation of interrupted area such as a gap in the transferring passage. Accordingly, there occurs no trouble when the recording sheet 2 which has been fed in that way is pulled in the backward direction.

As described above, the apparatus of the invention assures that the pinch rollers 8 can be simply released from the pressure contact state merely by actuating the sheet guiding member 5.

Figure 4:
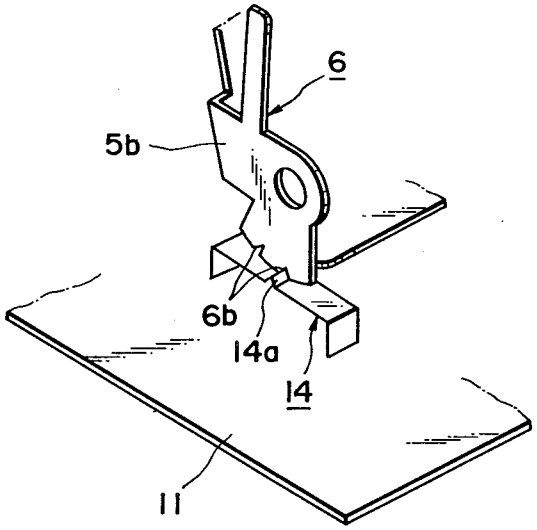
FIG. 4 is a fragmental perspective view of an apparatus in accordance with another embodiment of the invention.

In the foregoing embodiment the lever 6 is formed with a projection 6a having the triangular sectional shape in order to stepwise actuate the lever 6. However, the present invention should not be limited only to this. Alternatively, a releasing lever 6 as illustrated in FIG. 4 may be employed. In this embodiment the releasing lever 6 is formed with two V-shaped recesses 6b at the lower end part thereof and an inverted U-shaped leaf spring 14 fixedly secured to the base plate 11 is formed with a projection 14*a* adapted to enter one of the recesses 6*b*.

Further, in the foregoing embodiment a transferring roller 1 is employed as a transferring rotational member and a plurality of pinch rollers 8 are employed as pressure contact members. However, members for transferring a recording sheet should not be limited only to roller-shaped ones. Alternatively, the present invention can be applied to the case where transferring is achieved, for instance, by means of an endless belt adapted to be rotated. Moreover, pressure contact members should not be limited only to rotational ones. They may be non-rotational ones.

Figure 5A:
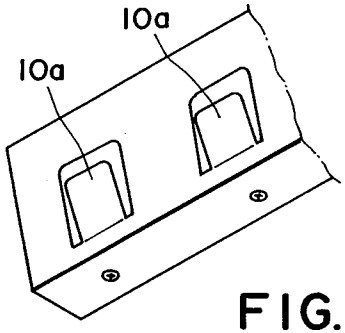
FIGS. 5A and 5B are fragmental views of an apparatus in accordance with another embodiment of the invention respectively.
Figure 5B:
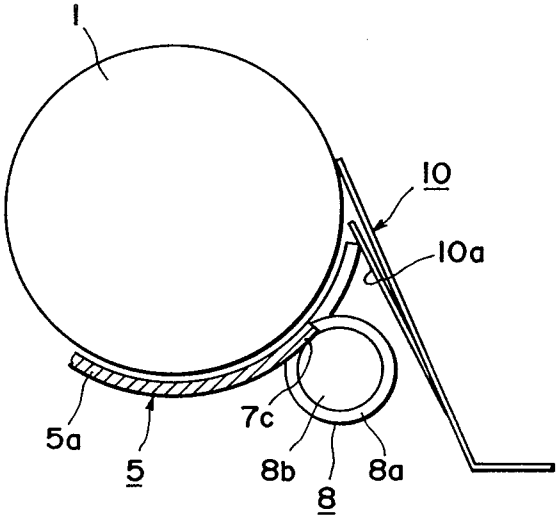

In the foregoing embodiment the sheet retainer 10 is constituted by a single thin plate. Alternatively, the sheet retainer 10 may be formed with two resilient deforming portions 10*a* having an inverted U-shaped shape in the area where the sheet guiding member 5 comes into contact with the sheet retainer 10. Each of the deforming portions 10*a* is produced by way of the steps of partially punching a part of the thin plate and then inwardly bending the thus partially punched part, as shown in FIG. 5A. This embodiment consists in that when the sheet guiding member 5 comes into contact with the deforming portions 10*a*, a pressing force is transmitted to the sheet retainer 10 via the deforming portions 10*a* with the result that a pressure contact force imparted to the transferring roller 1 by means of the sheet retainer 10 when the sheet guiding member 5 is displaced to come into contact with the latter is easy to be finely adjusted.

While the present invention has been described above with respect to a few preferred embodiments thereof, if should of course be understood that it should not be limited only to them but various changes or modifications may be made in any acceptable manner without departure from the spirit and scope of the invention as defined by the appended claims.

What is claimed is:

1. An apparatus for transferring sheet material essentially comprising:

a rotational transferring member for transferring said sheet material which is wound about the circumferential surface thereof;

means for pressing the sheet material against said rotational transferring member; and guiding means having a curved guiding surface spaced away from the circumferential surface of the rotational transferring member by a predetermined distance, disposed to turn along the circumferential surface of the rotational transferring member in such a manner that said predetermined distance is kept substantially unchanged and including an engagement portion adapted to detachably engage said pressing means, said guiding means being adapted to change at least the pressing force of the pressing means to be imparted to the rotational transferring member when it is turned relative to the rotational transferring member.

2. An apparatus as claimed in claim 1 wherein the guiding means is turnably supported on a rotational shaft of the rotational transferring member.

3. An apparatus as claimed in claim 1, wherein the thrusting means comprises a plurality of pressure rollers and when the guiding means is turned, pressing force of said pressure rollers to be imparted to the rotational transferring member is changed and thereby the spaced relation is changed.

4. An apparatus as claimed in claim 1 including a plurality of pressure rollers adapted to be normally urged toward the rotational transferring member, wherein, the pressing means comprises a sheet retainer which inhibits the sheet material from being floating up from the rotational transferring member.

5. An apparatus as claimed in claim 4, wherein the pressing means further includes said pressure rollers and when the guiding means is turned, the pressure rollers come in contact and out of contact with the rotational transferring member.

6. An apparatus as defined in claim 4, wherein said sheet retainer is constituted by a leaf spring.

7. An apparatus as claimed in claim 6, wherein the sheet retainer includes a plurality of resilient deforming portions which are producing by bending a part thereof and said resilient deforming portions are normally urged toward the rotational transferring member.

8. An apparatus as claimed in claim 1, wherein the guiding means is formed with an actuating lever which is projected outwardly therefrom.

9. An apparatus as claimed in claim 1, wherein the guiding means is operatively connected to another guiding means on which the sheet material is delivered to the first-mentioned guiding means and both the guiding means include a comb-shaped part respectively by of which they are brought in meshing engagement with one another.

10. An apparatus for transferring sheet material essentially comprising;

a rotational transferring member for transferring said sheet material which is wound about the circumferential surface thereof, first guiding means having a curved guiding surface spaced away from the circumferential surface of said rotational transferring member by a predetermined distance and disposed to turn along the circumferential surface of the rotational transfering member in such a manner that said predetermined distance is kept substantially unchanged, second guiding means having a guiding surface in continuation from a guiding surface of said first guiding means, said second guiding means being operatively connected to the first guiding means, and both the first and second guiding means having a connecting part comprising a plurality of projections and plurality of recesses respectively by way of which they are connected to one another by meshing engagement.

11. An apparatus as claimed in claim 10, wherein each of the projections on both the first and second guiding means has a rearward inclined face which is increasingly parted away from the guiding surface.

* * * * *

UNITED STATES PATENT AND TRADEMARK OFFICE

CERTIFICATE OF CORRECTION

PATENT NO. : 4,773,782

DATED : September 27, 1988

INVENTOR(S) : HIROFUMI HIRANO

It is certified that error appears in the above-identified patent and that said Letters Patent is hereby corrected as shown below:

Column 3, line 57, "partially explored" should be deleted.

Column 5, line 1, "in" should read --is--;

line 8, "of metallic" should read --of a metallic--.

Column 6, line 51, "for" should read --of--.

Column 8, line 14, "being" should be deleted;

line 25, "producing" should read --produced--.

Signed and Sealed this

Fourteenth Day of February, 1989

*Attest:*

DONALD J. QUIGG

*Attesting Officer*

*Commissioner of Patents and Trademarks*